US006379171B1

(12) United States Patent
Lin

(10) Patent No.: US 6,379,171 B1
(45) Date of Patent: Apr. 30, 2002

(54) ZIF SOCKET CONNECTOR

(75) Inventor: Nick Lin, Hsin-Chuang (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/855,812

(22) Filed: May 14, 2001

(30) Foreign Application Priority Data

Dec. 7, 2000 (TW) ..... 89221273 U

(51) Int. Cl.[7] ..... H01R 4/50; H01R 13/625

(52) U.S. Cl. ..... 439/342

(58) Field of Search ..... 439/342, 259

(56) References Cited

U.S. PATENT DOCUMENTS 6,280,223 B1 * 2/2000 Lin ..... 439/342

* cited by examiner

*Primary Examiner*—Brian Sircus
*Assistant Examiner*—Javaid Nasri
(74) *Attorney, Agent, or Firm*—Wei Te Chung

(57) ABSTRACT

A ZIF socket connector includes a base (1), a cover (2), and a driving device (3). The cover includes a deflecting device having at least one block (24) formed on an inner face of a side wall (20) of the cover and at least one projection (11) formed on lateral face (10) of the base. Before the cover slides on the base, each projection is positioned in front of each corresponding block. When the driving device is operated, the block climbs up the projection thereby displacing the cover relative to the base to avoid a front end (42) of a terminal (4) and then to get over and drop down the projection thereby reverting the cover to a level location relative to the base.

1 Claim, 6 Drawing Sheets

ZIF SOCKET CONNECTOR

BACKGROUND OF THE INVENTION

1. Field of the Invention

The present invention relates to a zero insertion force (ZIF) socket connector, and particularly to a ZIF socket connector having a cover capable of a displaced movement on a corresponding base.

2. Description of Related Art

A ZIF socket connector is used to connect a central processing unit (CPU) to a printed circuit board. In the prior art, the socket connector comprises a base, a cover and a driving device. The base defines a plurality of arrays of receiving holes, and a plurality of terminals is received in the corresponding receiving holes and soldered to circuit traces of the printed circuit board. The cover also defines a plurality of through holes corresponding to the receiving holes of the base. The CPU is positioned on the cover and the pins of the CPU extend through the through holes of the cover and further extend into the receiving holes without contacting the terminals. When the driving device is operated, the cover slides on the base with the pins sliding in the receiving holes of the base to contact the terminals of the socket connector for transmitting electrical signals between the CPU and the printed circuit board.

Referring to FIG. 11, a receiving hole 900 of the base of the socket connector comprises an inserting area 90 and a contacting area 92. A terminal 98 is received in the inserting area. A pin 96 of the CPU extends through a through hole 94 of the cover and further extends into the inserting area 90 of the receiving hole 900. Referring to FIG. 12, when the driving device is operated, the cover slides on the base with the pin 96 moving in a straight direction from the inserting area 90 to the contacting area 92 of the receiving hole 900. Referring to FIG. 13, if the pin 96 deflects from the center of the through hole 94 of the cover, the pin 96 will impact a front end of the terminal 98 to cause the terminal 96 deformed thereby influencing electrical connection between the pin and the terminal.

SUMMARY OF THE INVENTION

A main object of the present invention is to provide a ZIF socket connector having an assured engagement between pins of a CPU and terminals of the socket.

In order to achieve the object set forth, a ZIF socket connector comprises a base, a cover, and a driving device. The cover is positioned on the base and, when the driving device is operated, the cover can slide on the base. The cover comprises a pair of side walls, and one side wall forms at least one block on an inner face thereof. The base comprises a pair of lateral faces corresponding to the side walls of the cover, and one lateral face forms at least one semicircular projection corresponding to the at least one block of the cover. The at least one projection and the at least one block together form a deflecting device. When the driving device is operated, the at least one block climbs up the at least one projection thereby deflecting the cover relative to the base to avoid a pin of a CPU from impacting a front end of the terminal and then to get over and drop down the projection.

Other objects, advantages and novel features of the invention will become more apparent from the following detailed description when taken in conjunction with the accompanying drawings.

DETAILED DESCRIPTION OF THE INVENTION

Figure 1:
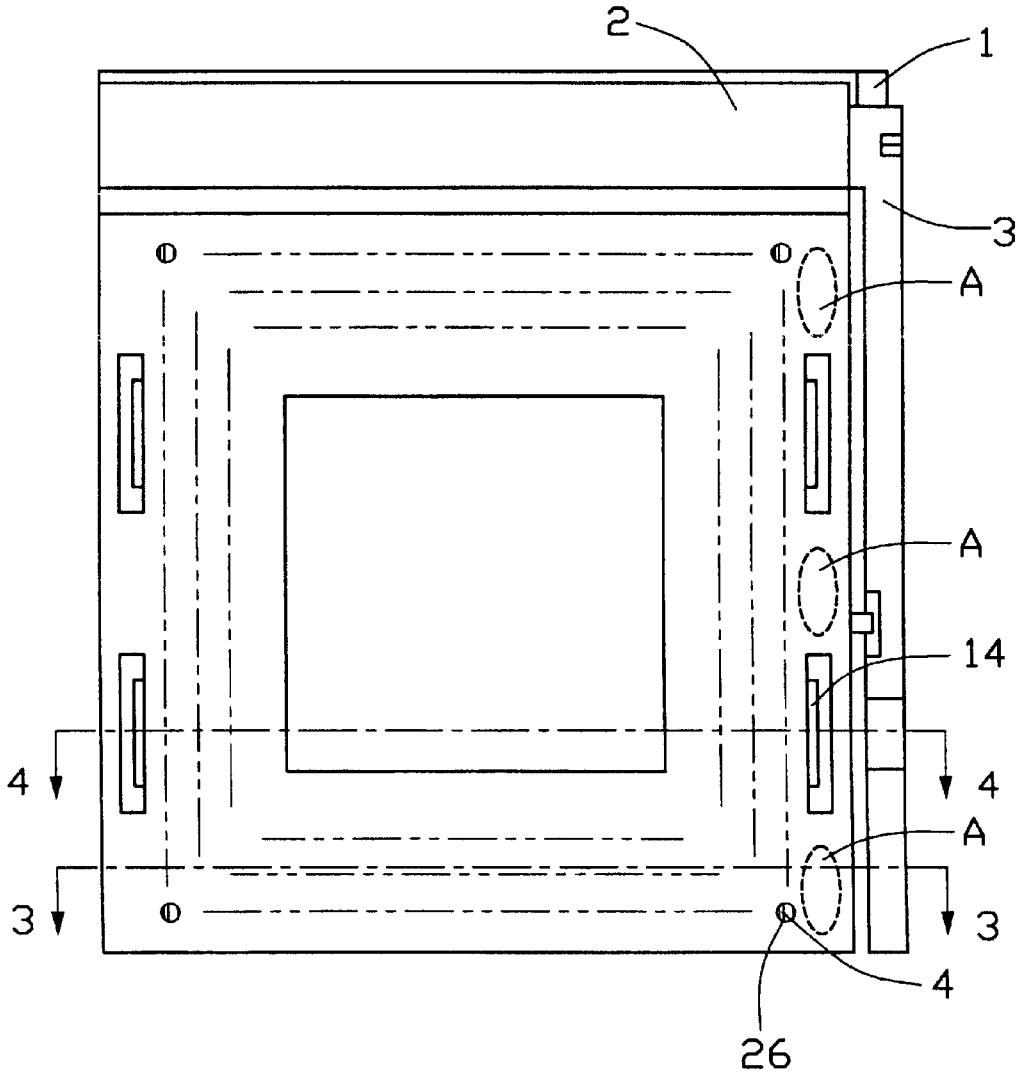
FIG. 1 is a top view of a ZIF socket connector of the present invention.

Referring to FIG. 1, a ZIF socket connector comprises a base 1, a cover 2, and a driving device 3 mounted on a rear end of the base 1. The cover 2 is positioned on the base I and, when the driving device 3 is operated, the cover 2 can slide on the base 1.

Figure 2:
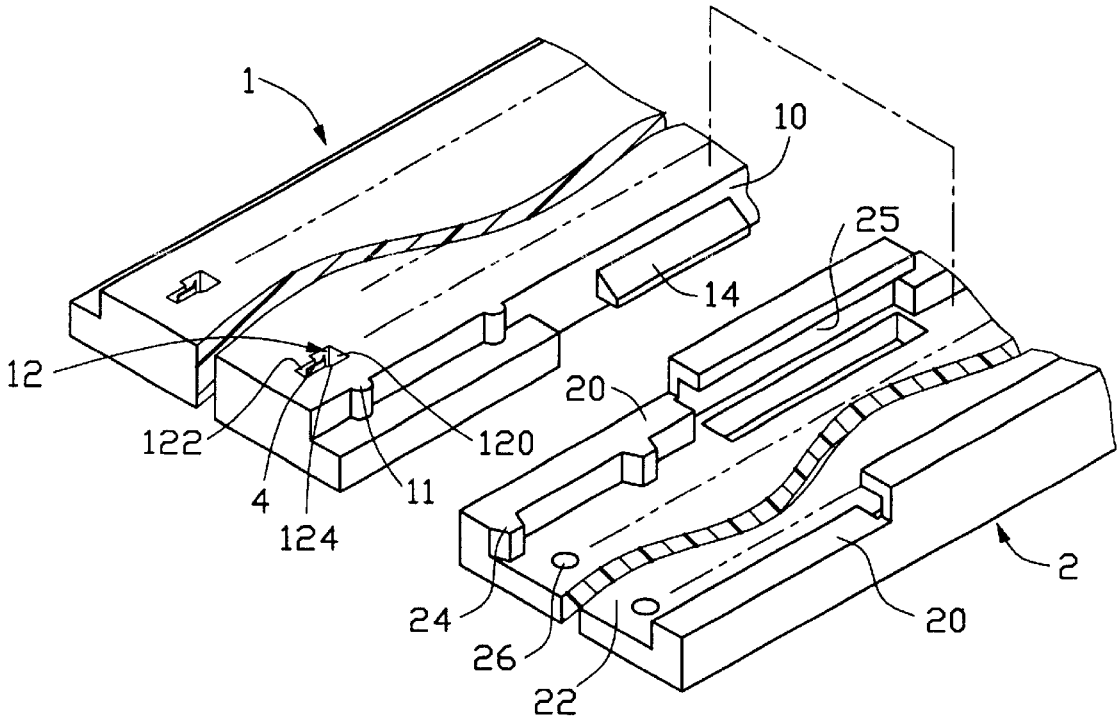
FIG. 2 is a perspective view of a base and a cover, in an upside down position, of the ZIF socket connector.

Referring to FIG. 2, a pair of side walls 20 extends from both sides of the cover 2, and a receiving space 22 is defined between both side walls 20. Six trapezoidal blocks 24 are formed on an inner face (not labeled) of one side wall 20 of the cover. Six semicircular columnar projections 11 are formed on a face 10 of the base 1 corresponding to the blocks 24 of the cover 2. Referring to FIG. 2, the blocks 24 and the projections 11 are divided into three groups located in ends and middle portions of the side wall 20 (on the right-hand side of the drawing sheet) and the lateral face 10 indicated by a character "A". Only two blocks 24 and two projections 11 are shown in FIG. 2. The blocks 24 and the corresponding projections 11 together form a deflecting device. Two pairs of sliding grooves 25 are defined in inner faces of both side walls 20. The sliding grooves 25 are positioned between every two adjacent blocks 24 of the right side wall 20. Two pairs of sliding blocks 14 are formed on both lateral faces 10 corresponding to the sliding grooves 25 and can slide in the corresponding grooves 25. A plurality of receiving holes 12 is defined in the base extending through upper face and bottom face thereof. Each receiving hole 12 comprises an inserting area 120 and a contacting area 122 narrow than the inserting area 120, and an inclined face 124 connecting the inserting area 120 and the contacting area 122. A plurality of terminals 4 is received in corresponding contacting areas 122. Each terminal 4 comprises a contact portion 40 at an upper end thereof, and the contact portion 40 has a front end 42. A plurality of through holes 26 is defined in the cover 2 corresponding to the receiving holes 12.

Figure 3:
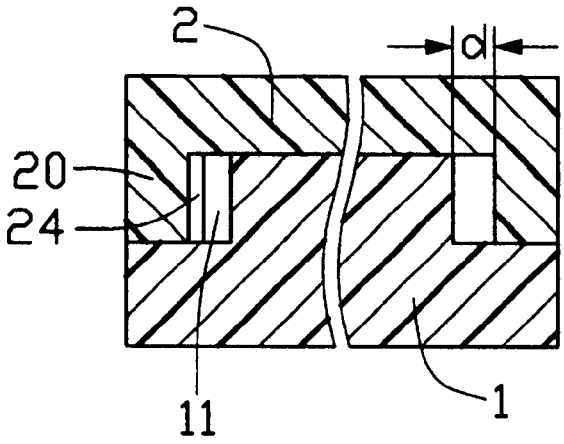
FIG. 3 is a cross sectional view taken along line 3—3 of FIG. 1.
Figure 4:
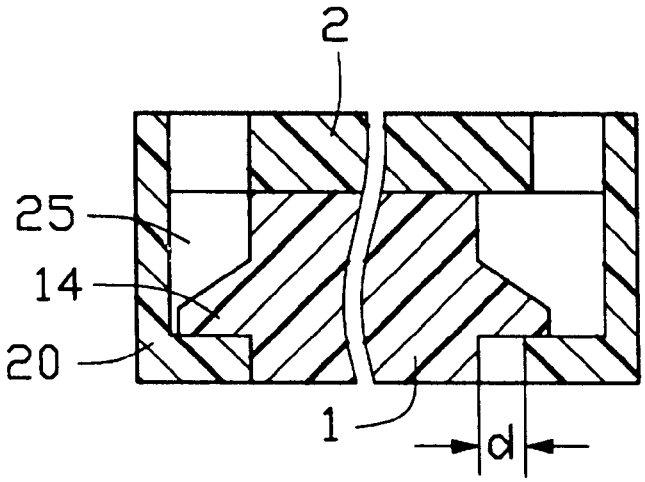
FIG. 4 is a cross sectional view taken along line 4—4 of FIG. 1.

Referring to FIGS. 3 and 4, the base 1 is received in the receiving space 22 of the cover 2, width of the receiving space 22 is bigger than width of the corresponding portion of the base 1 received in the receiving space 22, and a distance is defined between the inner face of the side wall 20 and the lateral face 10 indicated by a character "d" for allowing the deflecting device to operate. When the driving device is operated, each block 24 can slide along a contour of the corresponding semicircular column projection 11 whereby the base 1 is sidewardly displaced while moving with respect to the cover 2.

Figure 8:
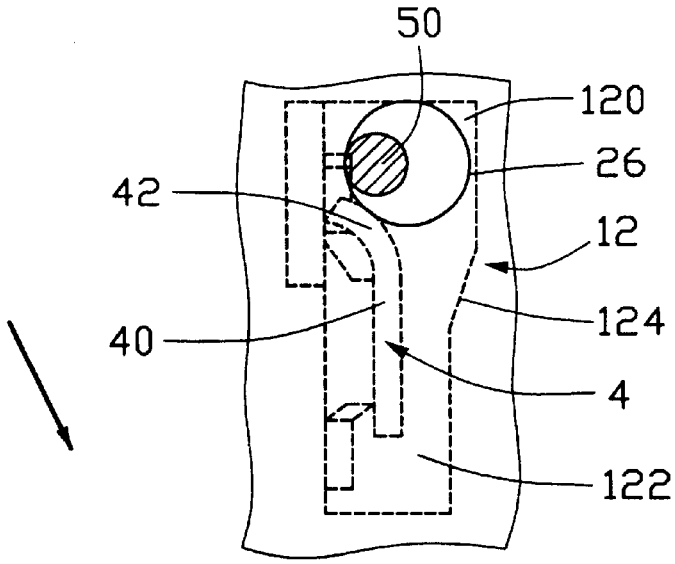
FIGS. 8, 9 and 10 are top views showing in sequence, a pin of a CPU moving in a receiving hole of the base according to the present invention.

Referring to FIG. 8, pins 50 (only one shown) of a CPU extend through the through holes 26 of the cover 2 into the inserting areas 120 of the receiving holes 12 of the base 1. When the driving device 3 is operated, the cover 2 will move on the base 1 with the pin 50 moving from the inserting area 120 to the contacting area 122.

Figure 5:
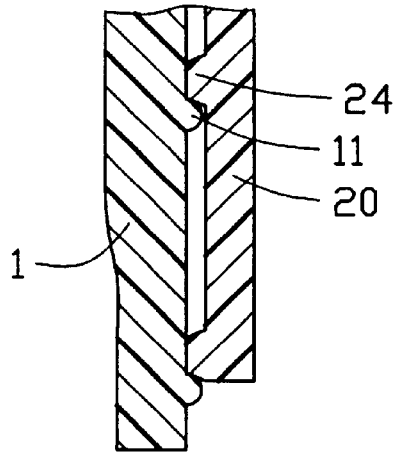
FIGS. 5, 6 and 7 are partly cross sectional view showing a sequential operation of a deflecting device.
Figure 6:
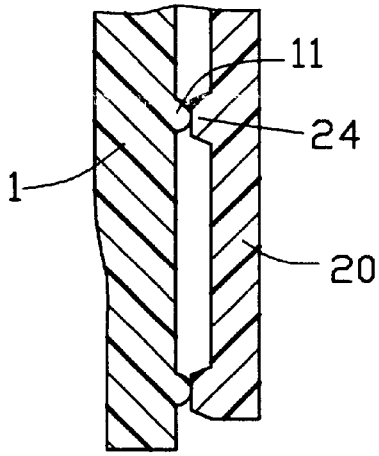
Figure 7:
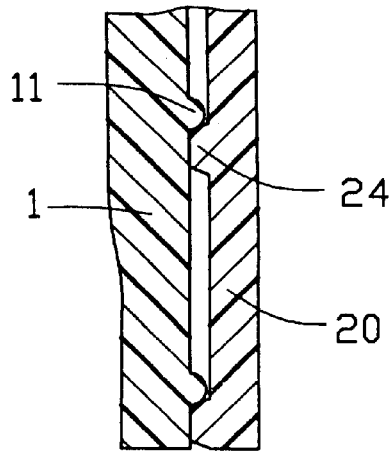
Figure 9:
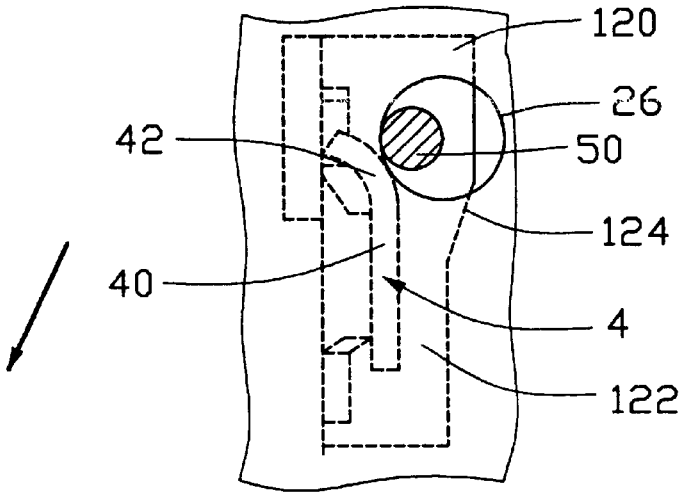
Figure 10:
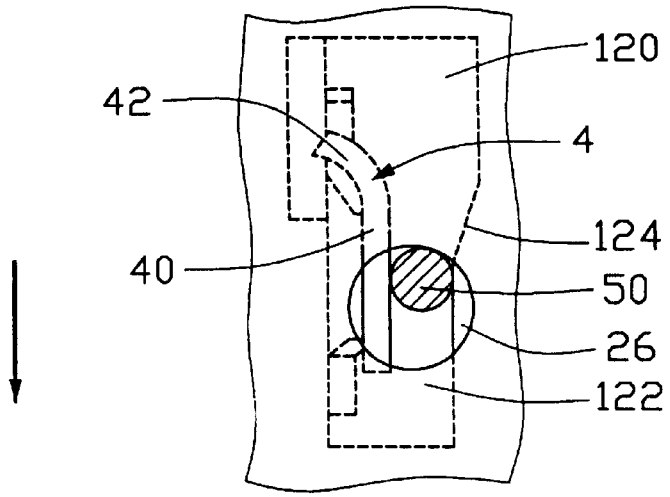
Figure 11:
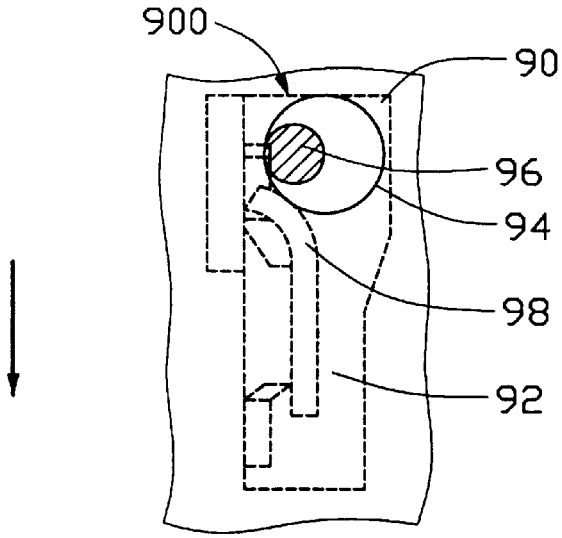
FIG. 11 (PRIOR ART)
FIGS. 11, 12 and 13 are top views showing a pin of the CPU moving in the receiving hole of a base according to prior art.
Figure 12:
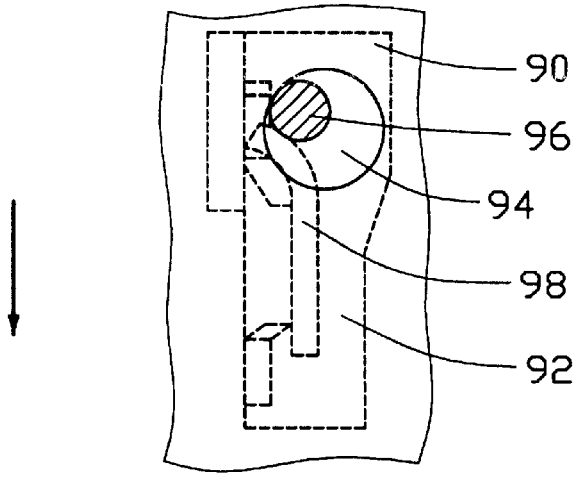
FIG. 12 (PRIOR ART)
Figure 13:
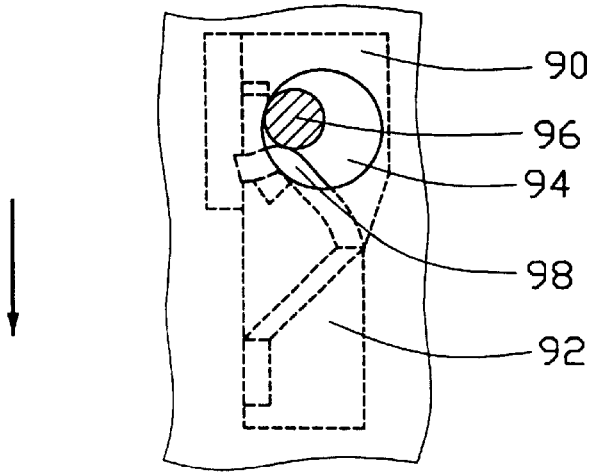
FIG. 13 (PRIOR ART)

Referring to FIG. 5, before the pin 50 moves, each projection 11 just locates in front of each corresponding block 24. When the pin 50 moves, the block 24 climbs up the projection 11 with the cover 2 displacing with respect to the base 1. Referring to FIG. 9, the pin 50 avoids a front end 42 of the terminal 4. Referring to FIGS. 7 and 10, when the cover 2 continues to move, the block 24 gets over and then drops down the projection 11 thereby reverting the cover to a level location relative to the base and the pin 50 passes through the inclined face 124 to continue into the contacting area 122 to contact the contact portion 40 of the terminal 4. Under this situation, a moving path defined by the cover includes at least a forward plus sideward section, and successively a forward plus inversely sideward section so that the pin may optionally approach the corresponding contact portion obliquely instead of forwardly.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A zero insertion force socket connector for interconnecting pins of a central processing unit (CPU) to a printed circuit board, comprising:

a base defining a plurality of arrays of receiving holes;

a plurality of terminals received in corresponding receiving holes, each terminal having a contact portion, the contact portion having a front end;

a cover defining a plurality of through holes corresponding to the receiving holes of the base for extending through by the pins of the CPU into the receiving holes;

a driving device mounted on an end of the base for moving the cover relative to the base; and a deflecting device comprising a plurality of blocks formed on an inner face of a side wall of the cover, and a plurality of projections formed on a lateral wall of the base corresponding to said blocks, respectively, said blocks being movable with the cover to climb up said projections, respectively, thereby displacing the cover relative to the base to avoid the pin from impacting the front end of the terminal, and then to get over and drop down the projections; wherein at least one sliding groove is defined in the inner face of the side wall of the cover, and at least one sliding block is correspondingly formed on the lateral face of the base for a sliding engagement in the at least one sliding groove; wherein the sliding groove is located between every two blocks on the side wall, and each sliding block is located between every two projections on the lateral face; wherein the receiving hole comprises an inserting area, and a contacting area narrower than the inserting area; wherein the projection is a semi-circular column; wherein a moving path defied by the cover includes at least a forward plus sideward section, and successively a forward plus inversely sideward section so that the pin may approach the corresponding contact portion obliquely instead of forwardly.

* * * * *